US010898039B2

(12) United States Patent
Brill et al.

(10) Patent No.: US 10,898,039 B2
(45) Date of Patent: Jan. 26, 2021

(54) HYGIENIC TOILET SEAT WITH REMOVABLE TRAY

(71) Applicants: Alan Brill, Boca Raton, FL (US); David Jablow, Boca Raton, FL (US)

(72) Inventors: Alan Brill, Boca Raton, FL (US); David Jablow, Boca Raton, FL (US)

(73) Assignee: BRILL HYGIENIC PRODUCTS, INC., Delray Beach, FL (US)

( * ) Notice: Subject to any disclaimer, the term of this patent is extended or adjusted under 35 U.S.C. 154(b) by 0 days.

(21) Appl. No.: 16/428,209

(22) Filed: May 31, 2019

(65) Prior Publication Data

US 2020/0375415 A1 Dec. 3, 2020

(51) Int. Cl.
*A47K 13/16* (2006.01)

(52) U.S. Cl.
CPC ..... *A47K 13/165* (2013.01)

(58) Field of Classification Search
CPC ..... A47K 13/105
USPC ..... 4/244.1–244.3
See application file for complete search history.

(56) References Cited

U.S. PATENT DOCUMENTS 5,926,875 A * 7/1999 Okamoto ..... A61G 7/02 5/604
5,937,448 A * 8/1999 Brill ..... A47K 13/145 4/243.1
6,006,370 A * 12/1999 Wu ..... A47K 13/16 4/244.3
7,389,550 B2 * 6/2008 Park ..... A47K 17/003 4/244.1
7,911,169 B2 * 3/2011 Wang ..... B65F 1/1607 318/480
9,289,102 B2 * 3/2016 Seibt ..... A47K 13/165
9,783,975 B2 * 10/2017 Bucher ..... E03D 9/035

* cited by examiner

*Primary Examiner* — Lori L Baker
(74) *Attorney, Agent, or Firm* — Shutts & Bowen LLP

(57) ABSTRACT

A sanitary toilet seat assembly is improved with a removable tray for capturing fluid and filth transported into the housing by the tubular protective film traveling from the toilet seat on to the take up spool in the housing. The removable tray is configured to be placed between a lower inner surface of a base member and the take-up shaft of the sanitary toilet seat assembly. The base member can include spaced vertical partitions extending from the inner surface of the base member and the removable tray can be positioned between the vertical partitions. The removable tray can include side walls in sliding contact with the vertical partitions. The base member can include a concave rear surface extending from the lower inner surface and the removable tray can include a corresponding shaped rear wall to slidingly engage the concave rear surface. The removable tray can also include a front wall extending from the side walls.

7 Claims, 3 Drawing Sheets

HYGIENIC TOILET SEAT WITH REMOVABLE TRAY

TECHNICAL FIELD

This invention relates generally to hygienic toilet seats and more particularly to an improved electromechanical toilet seat assembly that includes a removable tray.

BACKGROUND

Toilet seats in public restrooms can present significant challenges with respect to hygiene and cleanliness. Use of hygienic covers or toilet paper to cover the seats is both difficult and wasteful because the paper does not cover the entire seat and often falls into the toilet or onto the floor.

Alternative solutions include devices that can place a hygienic covering by a tubular film over the seat. Generally, these devices include a roll of tubular toilet seat cover material that extends from a supply reel, around the seat, to a take-up reel. The supply and take-up reels are contained in a housing that can also include a motor, electric power source, and pulley/gear arrangement. The portion of the housing that secures the take-up reel will typically become soiled with waste material and can be very difficult to clean. Furthermore, these hygienic toilet seat assemblies are typically cleaned or serviced by unsophisticated sanitation workers that are not familiar with how the mechanism works. Consequently, the inside of the housing is not thoroughly cleaned because the sanitation workers are not trained to remove components that inhibit access to interior portions of the housing. It would be desirable to provide an improved device for overcoming the aforementioned limitations.

SUMMARY OF THE INVENTION

A sanitary toilet seat assembly is improved with a removable tray for capturing fluid and filth transported into the housing by the tubular protective film traveling from the toilet seat on to the take up spool in the housing. The toilet seat assembly includes a toilet seat; a base member connected to and supporting the toilet seat; a top cover covering at least a portion of the base member, thereby forming a housing; a dispenser shaft proximate a first end of the toilet seat and configured to dispense tubular plastic material for extending around and covering the toilet seat; a take-up shaft proximate a second end of the toilet seat and configured to collect the tubular material; a motor within the housing for operatively driving the take-up shaft to advance tubular plastic material from the dispenser shaft to the take-up shaft; and a removable tray configured to be placed between a lower inner surface of the base member and the take-up shaft.

The base member can include spaced vertical partitions extending from the inner surface of the base member and the removable tray can be positioned between the vertical partitions. The removable tray can include side walls in sliding contact with the vertical partitions. The base member can include a concave rear surface extending from the lower inner surface and the removable tray can include a corresponding shaped rear wall to slidingly engage the concave rear surface. The removable tray can also include a front wall extending from the side walls.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the scope of the disclosure.

The disclosed technology addresses the need in the art for an improved electromechanical toilet seat assembly for automatically advancing a tubular sheet of sanitary covering material around a horseshoe shaped toilet seat and providing a removable tray to facilitate cleaning thereof.

Figure 1:
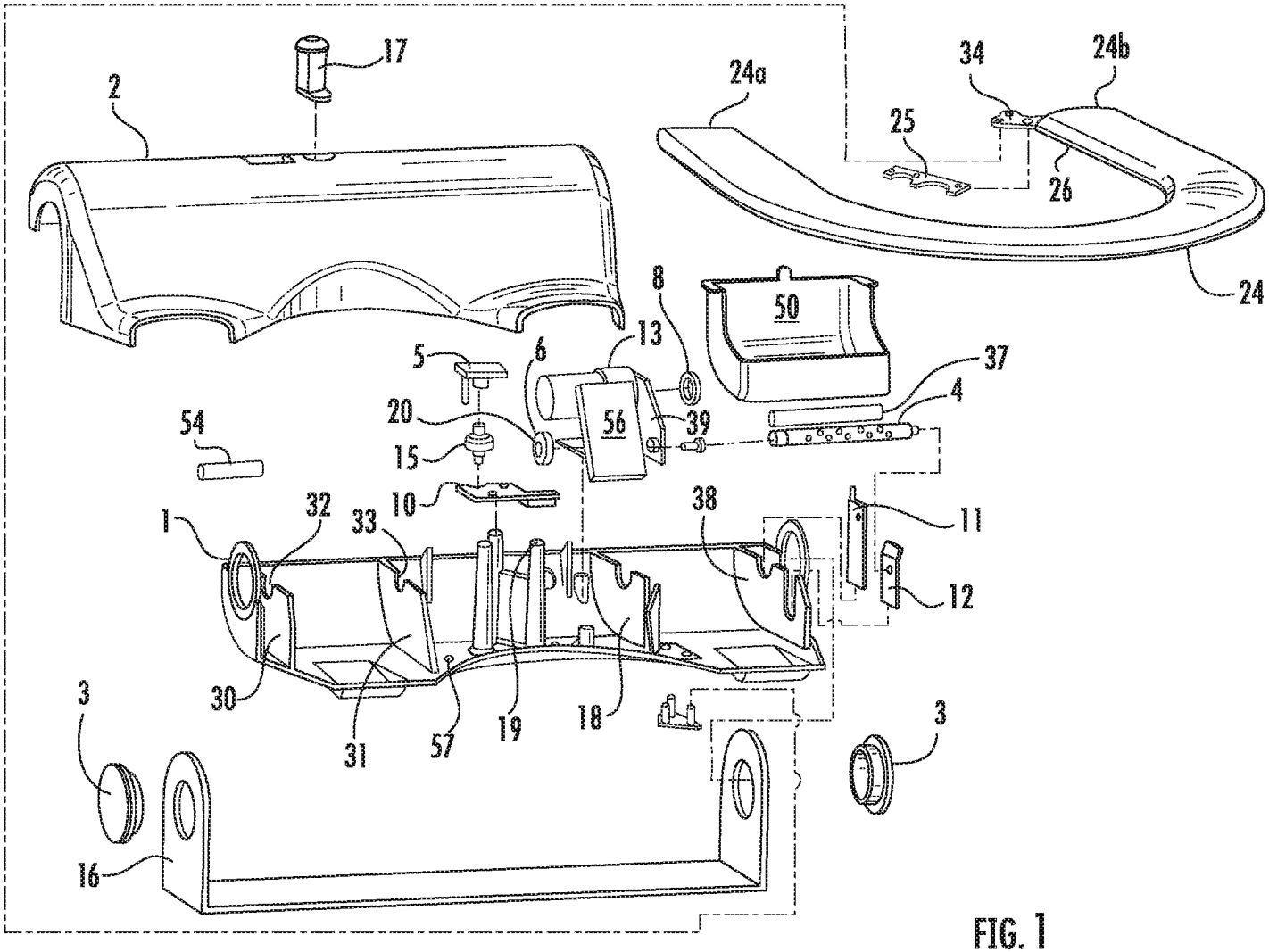
FIG. 1 is an exploded view of a toilet seat assembly in accordance with the present technology.

FIG. 1 is an exploded view of a toilet seat assembly in accordance with the present technology. The major structural components of the assembly can include a base member 1, a top cover 2, a seat 24, a mounting bracket 16, and a removable tray 50. As assembled, base member 1 and top cover 2 can form a housing for protecting various internal components, including a motor subassembly 13 and printed circuit board assembly 56. An activation button 5 is exposed through an opening in the top cover 2. A standard key lock 17 can be provided for locking the top cover 2 in place so as to prevent unauthorized access.

In operation, the activation button 5 can be manually depressed to advance the sanitary covering a sufficient length to provide a fresh seat covering over seat 24. Alternatively, the toilet seat assembly can include a light or motion sensor to activate the mechanism that provides a fresh seat covering.

The mounting bracket 16 can be provided for attaching the unit to the base of a toilet. End caps 3 extending through aligned circular openings in mounting bracket 16 and base member 1 can allow the entire seat assembly to be rotated about an imaginary axis joining the centers of the end caps 3.

In some embodiments, base member 1 comprises a unitary molded plastic having a number of integrally molded support structures. In addition, the toilet seat assembly can incorporate drain holes 57 extending through the bottom of the base member 1 to allow removal of fluids which could potentially accumulate in the housing and deteriorate internal components. Base member 1 can include partitions 30 and 31 for supporting a dispense roll shaft 54. Opposite ends of the dispense roll shaft 54 can be supported on recesses 32 formed in partitions 30 and 31. The toilet seat assembly can also incorporate integral stop mechanisms 33 for limiting horizontal movement of dispense roll shaft 54.

The tubular cover material can fit over seat end 24*a*. The cover material can extend completely around the seat 24, pass over counter shaft 4, and can be rewound on a take-up shaft 37. The take-up shaft 37 can be supported at one end by spring plate 11 attached to the outer surface of a partition 38. The opposite end of the take-up shaft 37 can mate or otherwise connect to a drive motor hub 8 which is attached to a drive shaft (not shown) extending from an end of motor 13.

Figure 2:
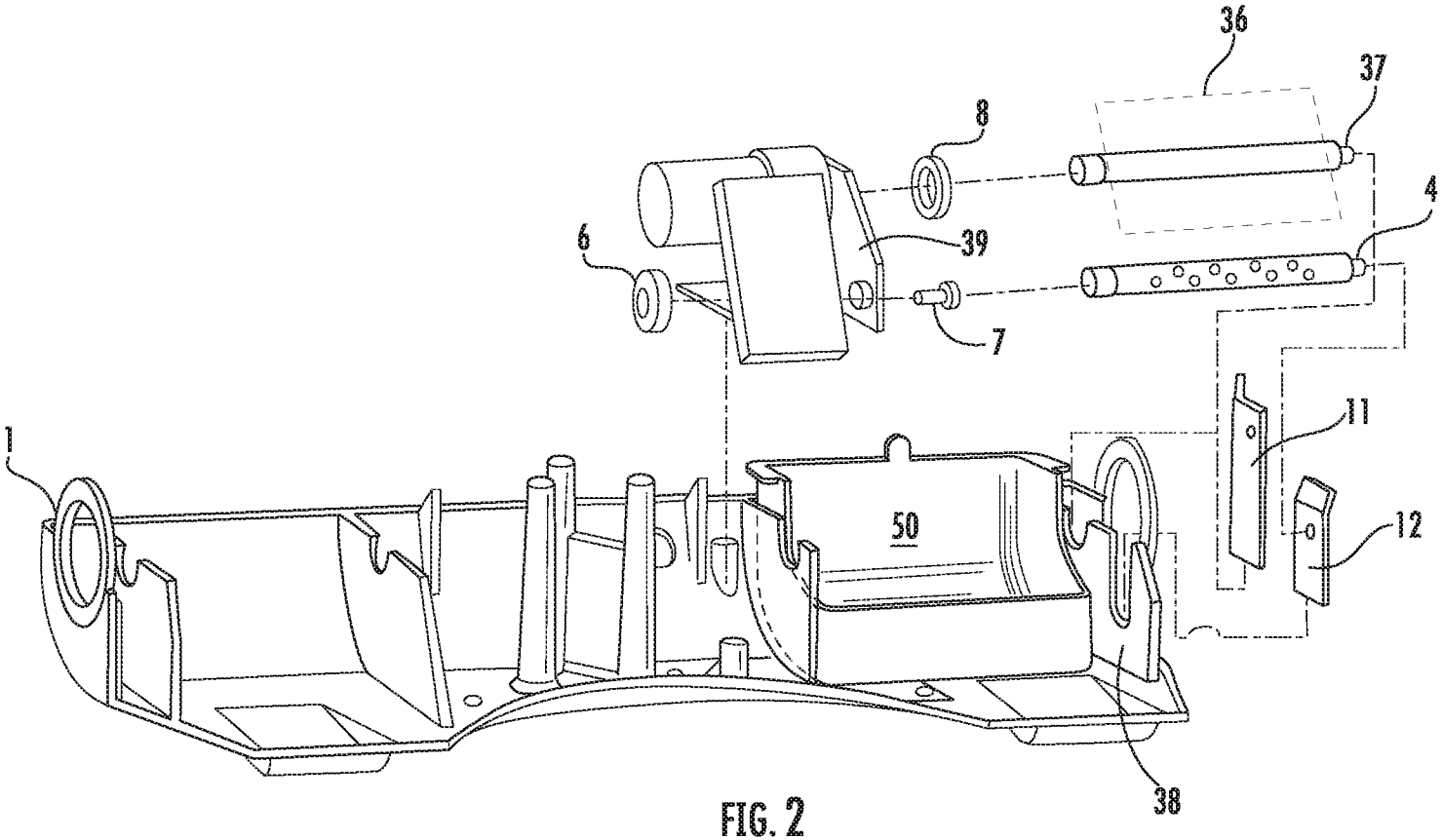
FIG. 2 is a second exploded view of a toilet seat assembly in accordance with the present technology.

The removable tray 50 that can be placed within base member 1 such that removable tray 50 is only accessible upon removal of top cover 2. Removable tray 50 can be designed to fit between partition 38 and partition 18 and provide cover or protection to the inside surface of base member 1. Removable tray 50 can also include side panels that provide cover or protection to the inside surface of partition 38 and partition 18, which are adjacent to take-up shaft 37. As can be seen, side walls or panels of removable tray 50 (e.g., side walls or panels 304 and 308 of FIG. 3 and the corresponding structures of removable tray 50 of FIGS. 1 and 2) may be in sliding contact with vertical partitions 38 and 18 as shown in FIG. 2. The side panels of removable tray 50 can also include perpendicular extensions or tabs that permit removable tray 50 to rest or be seated upon partition 38 and partition 18. In addition, the sidewall tabs or extensions can also provide proper alignment (i.e. orientation) and placement of removable tray 50. In some embodiments, removable tray 50 can have a convex outer surface having a curvature that is substantially the same as an inner surface of base member 1. That is, the construction of removable tray 50 can provide a secure, complementary fit to base member 1 such that untrained sanitation workers can easily remove and re-install removable tray 50.

The removable tray 50 can be designed to have a width that is substantially the same as the distance between partition 38 and partition 18 such that removable tray 50 can fit securely between the partitions. In some embodiments, the removable tray 50 can include a latch or mechanical fastening mechanism to secure removable tray 50 to base member 1. As illustrated in further detail in connection with FIGS. 3 and 4, removable tray 50 can also include a top tab or protrusion (e.g., top tab or protrusion 314 of FIG. 3 and the corresponding structure of removable tray 50 of FIGS. 1 and 2) that facilitates handling (e.g. removal and placement) by an operator. For example, the top tab can provide a convenient method of taking out removable tray 50 that can reduce the likelihood of spilling any waste materials collected therein.

In some embodiments, the removable tray 50 can be formed from a molded plastic material. In operation, the removable tray 50 can collect and capture solid or liquid waste materials that enter the housing of the toilet seat assembly when the tubular cover material is collected onto take-up shaft 37. When installed within base member 1, the removable tray 50 can keep the inside of base member 1 clean and free of waste materials, which facilitates cleanliness and durability of the toilet seat assembly. That is, an operator can remove top cover 2 to access and remove removable tray 50 for cleaning.

Removable tray 50 can also be designed such that it can receive the roll on the take-up shaft 37 as its volume and/or diameter increases through repeated usage cycles. That is, when a new roll of tubular material is installed on dispense roll shaft 54, the old material on take-up shaft 37 will presumably be discarded and the roll on take-up shaft 37 will be at a minimum diameter. With each cycle, take-up shaft 37 will collect the used tubular material causing the roll on take-up shaft 37 to increase in diameter. In some embodiments, removable tray 50 can be designed to accommodate a maximum diameter of a roll on take-up shaft 37 that corresponds with the maximum diameter of the roll of new material installed on dispense roll shaft 54.

Toilet seat 24 can have a slot 26 formed at one end to facilitate attachment of plate 34 and razor subassembly 25. A portion of attachment plate 34 can be integrally molded into slot 26 of seat 24.

Razor subassembly 25, which can fit into a wider section of slot 26, can have an integrally molded raised bump formed on its surface for mating with an opening in plate 34. This feature of the assembly can provide a mechanism for releasably locking the razor blade assembly in place. The razor subassembly 25 can extend at an obtuse angle in relation to the advancing covering material, and serves to slit the edge of the cover material as it is pulled off and wound up on the take-up shaft 37. Slitting the cover material prevents its reuse. The seat assembly can also have an integral pressure plate (not illustrated) extending downward at an angle from the inner surface of top cover 2. The integral pressure plate can press advancing cover material against counter shaft 4 to improve contact between the cover material and the outer surface of the counter shaft 4.

Counter shaft 4 can be supported at one end by spring plate 12 attached to the outer surface of partition 38. The opposite end of counter shaft 4 can be joined to magnet wheel 6 via counter drive shaft element 7 extending through an opening in motor support plate 39. Counter shaft 4 can be formed of a molded plastic and have a plurality of integrally molded raised surface portions for gripping advancing cover material. In particular, the raised surface portions can improve friction between the advancing cover material and the counter shaft surface, thereby improving rotational precision of the counter shaft 4 during advancement of the cover material. The toilet seat assembly can incorporate a pressure plate integrally molded into top cover 2. In an assembled state, the pressure plate can apply a downward force on the advancing cover material to further improve contact between the advancing cover material and the counter shaft surface.

Magnet wheel 6 can have a magnet 20 attached to an outer wheel surface. In some embodiments, magnet 20 can communicate with electronic circuitry mounted on the printed circuit board assembly 56. The electronic circuitry of the toilet seat assembly can monitor the number of rotations of wheel 6. Rotation of wheel 6 is a direct result of rotation of counter shaft 4. Consequently, resistance in the advancement of cover material, which affects the rotation of shaft 4, can be detected by the electronic circuitry. The circuitry of the present invention can be designed to halt operation of motor 13 in instances where a specified resistance level is encountered. In some embodiments, motor subassembly 13 can be supplied approximately 12 volts dc which can be supplied via a 12 v dc converter or, alternatively, the assembly can be operated with batteries.

The toilet seat assembly of the present technology can incorporate the activation button 5 operating independently of internal mechanical components, including the dispense and take up roll shafts. Consequently, activation of the assembly is not dependent upon the mechanical integrity of other assembly components. Furthermore, the button 5 can have an improved ergonomic design which is less prone to damage by external forces. In a released state, the upper surface of activation button 5 lies substantially flush with the upper surface of top cover 2 and the sides of the button are bounded by the periphery of the opening in the top cover through which the button is exposed. As a result, activation button motion is limited to vertical displacement upon contact. The activation button 5 can also have an integrally molded guide leg which can be received in an opening in push switch assembly support plate 10 to prevent rotation of activation button 5 as it is being depressed. Support plate 10 can be mechanically fastened to support plate mounting structure 19 integrally formed in base member 1.

Activation button 5 can be pushed to actuate switch assembly 15 for activating motor assembly 13. A drive shaft extending from motor assembly 13 can rotate hub 8 which, in turn, rotates take-up shaft 37. As the take-up shaft 37 is rotated, cover material is pulled off of the dispense shaft roll and advanced around toilet seat 24. Advancing cover material is forced against the outer surface of counter shaft 4 by a pressure plate, causing counter shaft 4 to rotate. Rotation of the counter shaft 4 effects corresponding rotation of magnet 20 on magnet wheel 6. At seat end 24*b*, the left inside-facing edge of the cover can be slit by razor assembly 25 in order to allow it to be wound up on take-up shaft 37. The amount of material advanced can be determined by rotation of counter shaft 4. That is, rotations can be computed by electronic circuitry (not shown) which tracks the rotation of magnet 20 on magnet wheel 6. Where specified resistance limits are exceeded, the electronic circuitry can communicate with motor assembly 13 to halt operation of the motor.

FIG. 2 is a second exploded view of a toilet seat assembly in accordance with the present technology. FIG. 2 illustrates an embodiment of toilet seat assembly in which removable tray 50 is placed inside of base member 1. Removable tray 50 can be placed in a section of base member 1 that includes counter shaft 4 and take-up shaft 37.

As discussed in connection with FIG. 1, take-up shaft 37 can be configured to collect the tubular plastic material 36 dispensed to protect the toilet seat. Take-up shaft 37 can be supported at one end by spring plate 11 attached to the outer surface of partition 38. Alternatively, take-up shaft 37 can be supported directly by partition 38, and/or a mechanism similar to spring plate 11 can be formed as part of partition 38. The opposite end of the take-up shaft 37 can be connected either directly or indirectly to a drive motor.

Counter shaft 4 can be supported at one end by spring plate 12 attached to the outer surface of partition 38. Alternatively, counter shaft 4 can be supported directly by partition 38, and/or a mechanism similar to spring plate 12 can be formed as part of partition 38. The opposite end of counter shaft 4 can be joined to magnet wheel 6 via counter drive shaft element 7 extending through an opening in motor support plate 39.

As the tubular film is collected by take-up shaft 37, waste material may enter the housing of the toilet seat assembly. Removable tray 50 can be positioned and configured to collect the waste material and protect the inside surface of base member 1. Removable tray 50 can be detached from base member 1 to facilitate cleaning of removable tray 50.

Figure 3:
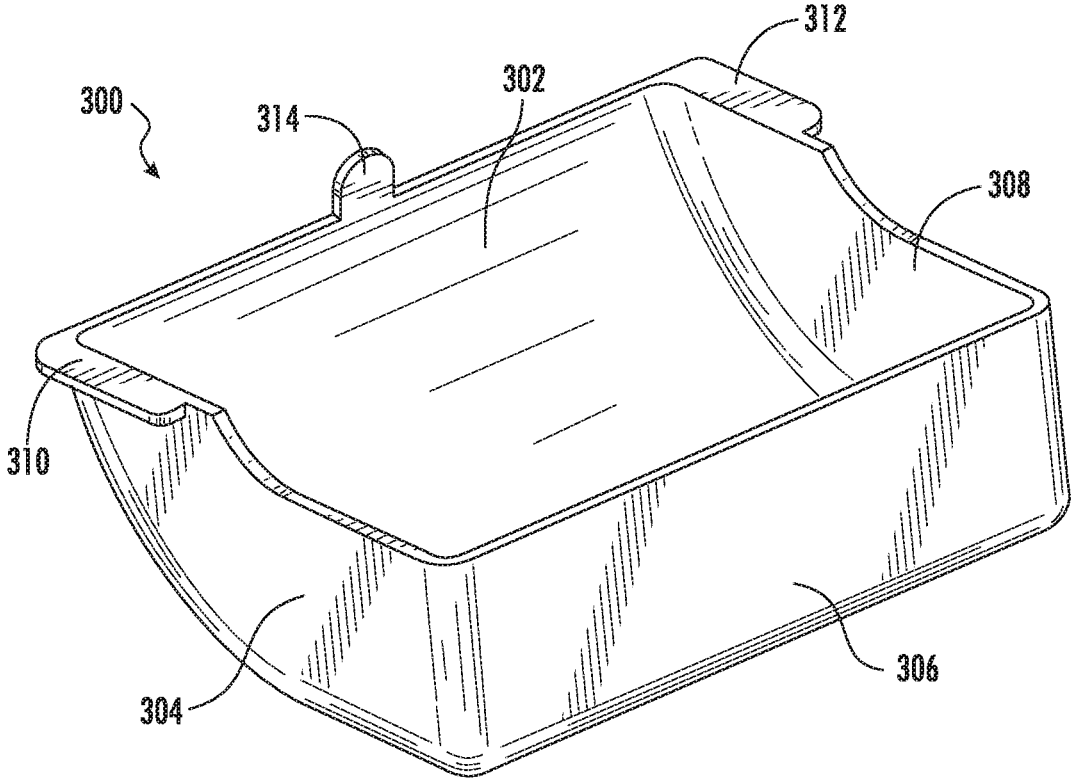
FIG. 3 is a perspective view of a hygienic toilet seat tray.

FIG. 3 illustrates a perspective view of a hygienic toilet seat tray 300 in accordance with the present technology. Hygienic toilet seat tray 300 can include a bottom or base planar surface 302 having a shape or curvature that is substantially similar to the inside housing of a toilet seat assembly that provides a complementary and secure fit within the assembly.

Hygienic toilet seat tray 300 can also have sidewalls 304, and 308 that extend upward from the sides of base surface 302 as well as a front wall 306 that is between sidewalls 304 and 308 extends upward from a front edge of base surface 302. Sidewalls 304, and 308 and front wall 306 can be formed as a single continuous enclosure or barrier, or may comprise separate elements that are assembled together with base surface 302. In some embodiments, hygienic toilet seat tray 300 has a unitary construction in which base surface 302, sidewalls 304, and 308, and front wall 306 are formed from a molded plastic material.

Base surface 302 and sidewalls 304, and 308, and front wall 306 together define an internal space or cavity. Hygienic toilet seat tray 300 can be placed behind or in close proximity to a take-up real within an electro-mechanical toilet seat such that any waste or dirt that is drawn in by the take-up real is collected within the internal space of toilet seat tray 300. Hygienic toilet seat tray 300 can be inserted and removed from the housing of an electro-mechanical hygienic toilet seat to facilitate cleaning.

In some embodiments, hygienic toilet seat tray 300 can include side extensions or tabs such as side tabs 310 and 312. Side tabs 310 and 312 can be configured to provide support for tray 300 by resting upon structural elements disposed within a toilet seat assembly. As illustrated, side tabs 310 can extend across a portion of the top of sidewall 310 and 312. However, tabs that extend across the entirety of the sidewalls are also contemplated herein. In further embodiments, tabs may also be extended from a top surface of front wall 306.

Hygienic toilet seat tray 300 can also include a top tab 314 that can be used to easily grip tray 300 for removal and insertion from a toilet seat assembly. By using top tab 314, a sanitation workers can easily remove tray 300 and minimize the risk of spilling any waste material that is collected inside. Top tab 314 can also facilitate placement of tray 300 in its appropriate location without having to touch other components or areas of the toilet seat assembly.

Figure 4:
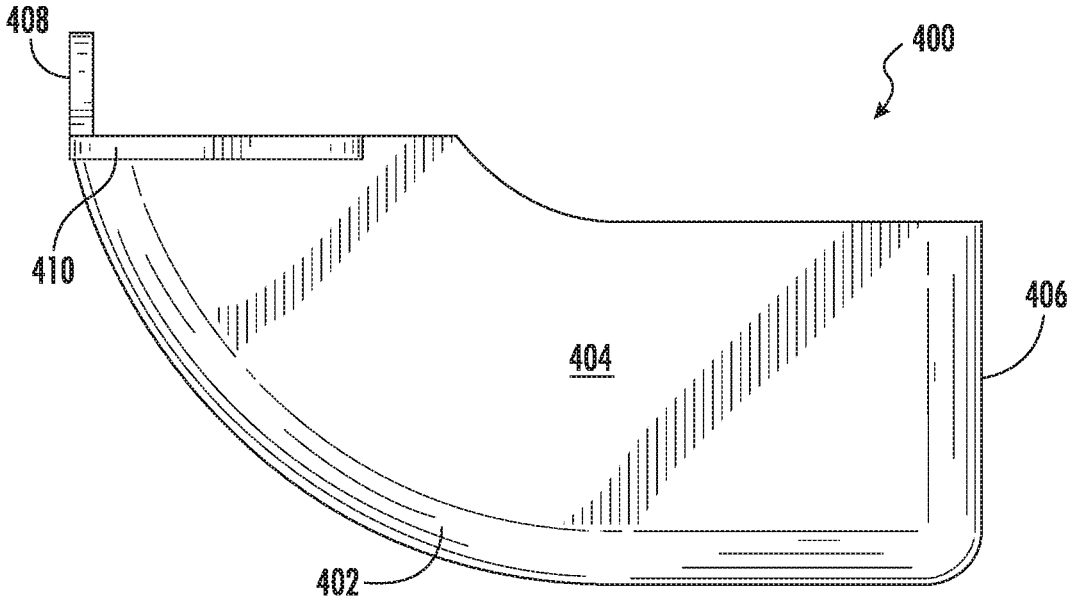
FIG. 4 is a side elevation view of a hygienic toilet seat tray.

FIG. 4 is a side elevation view of a hygienic toilet seat tray 400 in accordance with the present technology. Hygienic toilet seat tray 400 can have bottom or base surface 402 that can be integrally formed with either of sidewall 404 and front wall 406. In some embodiments, base surface 402 can have a shape or curvature configured to mate with the inside surface of the housing for a hygienic toilet seat.

Hygienic toilet seat tray 400 can also have a top tab 408 to facilitate handling (e.g. removal or insertion) of tray 400. Hygienic toilet seat 400 can also have protrusions or tabs extending in an outward direction that is perpendicular to sidewall 404 such as side tab 410. Side tab 410 can be used to allow tray 400 to be self-seating by resting upon structural elements within a toilet seat assembly.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Numerous modifications, changes, variations, substitutions and equivalents will occur to those skilled in the art without departing from the spirit and scope of the present invention as described in the claims.

The invention claimed is:

1. A sanitary toilet seat assembly comprising:

a toilet seat;

a base member connected to and supporting the toilet seat;

a top cover covering at least a portion of the base member, thereby forming a housing;

a dispenser shaft proximate a first end of the toilet seat and configured to dispense tubular plastic material for extending around and covering the toilet seat;

a take-up shaft proximate a second end of the toilet seat and configured to collect the tubular material;

a motor within the housing for operatively driving the take-up shaft to advance tubular plastic material from the dispenser shaft to the take-up shaft; and a removable tray configured to be placed between a lower inner surface of the base member and the take-up shaft.

2. The sanitary toilet seat of claim 1, wherein the base member includes spaced vertical partitions extending from the inner surface of the base member and the removable tray is configured to be positioned between the vertical partitions.

3. The sanitary toilet seat of claim 2, wherein the removable tray includes side walls in sliding contact with the vertical partitions.

4. The sanitary toilet seat of claim 3, wherein the base member includes a concave rear surface extending from the lower inner surface and the removable tray comprises a corresponding shaped rear wall configured to slidingly engage the concave rear surface.

5. The sanitary toilet seat of claim 4, wherein the removable tray comprises a front wall extending from the side walls.

6. The sanitary toilet seat of claim 5, wherein the removable tray includes a top tab extending upwardly from the rear wall.

7. The sanitary toilet seat of claim 6, wherein the removable tray includes a protrusion extending outwardly and perpendicularly from each of the side walls, whereby the removable tray is configured to be self-seating by resting said protrusion upon the vertical partitions.

* * * * *